US005544512A

United States Patent [19]

Shieh

[11] Patent Number: 5,544,512

[45] Date of Patent: Aug. 13, 1996

[54] BURGLARYPROOF AXIAL PIN TUMBLER LOCK

[76] Inventor: Jin-Ren Shieh, No. 178, Shih Chia Rd., Taichung, Taiwan

[21] Appl. No.: 294,593

[22] Filed: Aug. 23, 1994

[51] Int. Cl.[6] ..... E05B 27/00

[52] U.S. Cl. ..... 70/491; 70/395; 70/397; 70/404; 70/419

[58] Field of Search ..... 70/490, 491, 493, 70/368, 369, 378, 395–400, 402–404, 416, 419–421, 423, 427, 453–455

[56] References Cited

U.S. PATENT DOCUMENTS

| | | | |
|---|---|---|---|
| 14,958 | 5/1856 | Hendrickson | 70/397 |
| 291,686 | 1/1884 | Clark | 70/402 X |
| 312,819 | 2/1885 | Colby | 70/395 X |
| 591,901 | 10/1897 | Trotman | 70/395 |
| 1,984,202 | 12/1934 | Shinn | 70/404 |
| 3,251,205 | 5/1966 | Kerr | 70/404 X |
| 3,267,707 | 8/1966 | Adams | 70/395 X |
| 4,831,853 | 5/1989 | Liao | 70/491 |
| 5,020,349 | 6/1991 | Lee | 70/491 |
| 5,174,140 | 12/1992 | Lee | 70/398 X |
| 5,402,660 | 4/1995 | Osada | 70/404 X |

FOREIGN PATENT DOCUMENTS

| | | | |
|---|---|---|---|
| 2344285 | 11/1974 | Germany | 70/491 |

*Primary Examiner*—Steven N. Meyers
*Assistant Examiner*—Suzanne L. Dino
*Attorney, Agent, or Firm*—Browdy and Neimark

[57] ABSTRACT

An axial pin tumbler lock comprises a housing, an outer tumbler pin seat, a plurality of outer tumbler pins, an inner tumbler pin seat, and a plurality of inner tumbler pins. The smallest distance between the center of the outer tumbler pin seat and the outer edge of at least one of the outer tumbler pins is greater than the radius of the first axial hole of the housing, so as to enable the outer tumbler pin in question to be concealed by a shoulder located between the first axial hole and the second axial hole of the housing.

7 Claims, 4 Drawing Sheets

BURGLARYPROOF AXIAL PIN TUMBLER LOCK

FIELD OF THE INVENTION

The present invention relates generally to an axial pin tumbler lock, and more particularly to an axial pin tumbler lock capable of protecting against the burglary.

BACKGROUND OF THE INVENTION

As shown in FIGS. 1–3, an axial pin tumbler lock of the prior art comprises a lock 10 and a key 20. The lock 10 comprises: a housing 11 provided therein with a first axial hole 111 and a second axial hole 112; an outer tumbler pin seat 12 received in the second axial hole 112 and provided with a plurality of tumbler pin through holes 121 and with a lock core 122; a plurality of outer tumbler pins 13 of various lengths and received slidably in the tumbler pin through holes 121; an inner tumbler pin seat 14 received in the second axial hole 112 and provided with a third axial hole 141 dimensioned to receive therein the lock core 122; a plurality of inner tumbler pins 15; and a plurality of springs 16. The key 20 comprises a handle 21 and a cylinder 22 having an outer diameter corresponding to an inner diameter of the first axial hole 111. The cylinder 22 is provided at the free end thereof with a plurality of retaining slots 23 which are corresponding in location to the outer tumbler pins 13 and are of different lengths.

In operation, the cylinder 22 of the key is inserted into the first axial hole 111 of the lock 10 such that the retaining slots 23 force the outer tumbler pins 13 and the inner tumbler pins 15 to move inwards so as to cause the junctions between the outer tumbler pins 13 and the inner tumbler pins 15 to be corresponding to the junction between the inner tumbler pin seat 14 and the outer tumbler pin seat 12. In the meantime, the handle 21 of the key 20 is so rotated as to force the cylinder 22 to actuate the lock core 122 via the retaining slots 23 and the outer tumbler pins 13.

Such a prior art axial pin tumbler lock as described above is inherently defective in design in that the outer tumbler pins 13 are partially exposed in the first axial hole 111 in order to be received in the retaining slots 23 of the key 20, thereby permitting an unauthorized person to see through one-end of the lock 10 the precise location of each of the outer tumbler pins 13, as shown in FIG. 3.

SUMMARY OF THE INVENTION

It is therefore the primary objective of the present invention to provide an axial pin tumbler lock with means capable of protecting the axial pin tumbler lock from being burglarized.

It is another objective of the present invention to provide an axial pin tumbler lock with the outer tumbler pins which are not exposed.

In keeping with the principle of the present invention, the foregoing objectives of the present invention are attained by a burglaryproof axial pin tumbler lock, which comprises a housing, an outer tumbler pin seat, a plurality of outer tumbler pins, an inner tumbler pin seat, and a plurality of inner tumbler pins. The smallest distance between the center of the outer tumbler pin seat and the outer edge of at least one of the outer tumbler pins is greater than the radius of the first axial hole of the housing, so as to enable the outer tumbler pin in question to be concealed by a shoulder located between the first axial hole and the second axial hole of the housing.

DETAILED DESCRIPTION OF THE INVENTION

Figure 1:
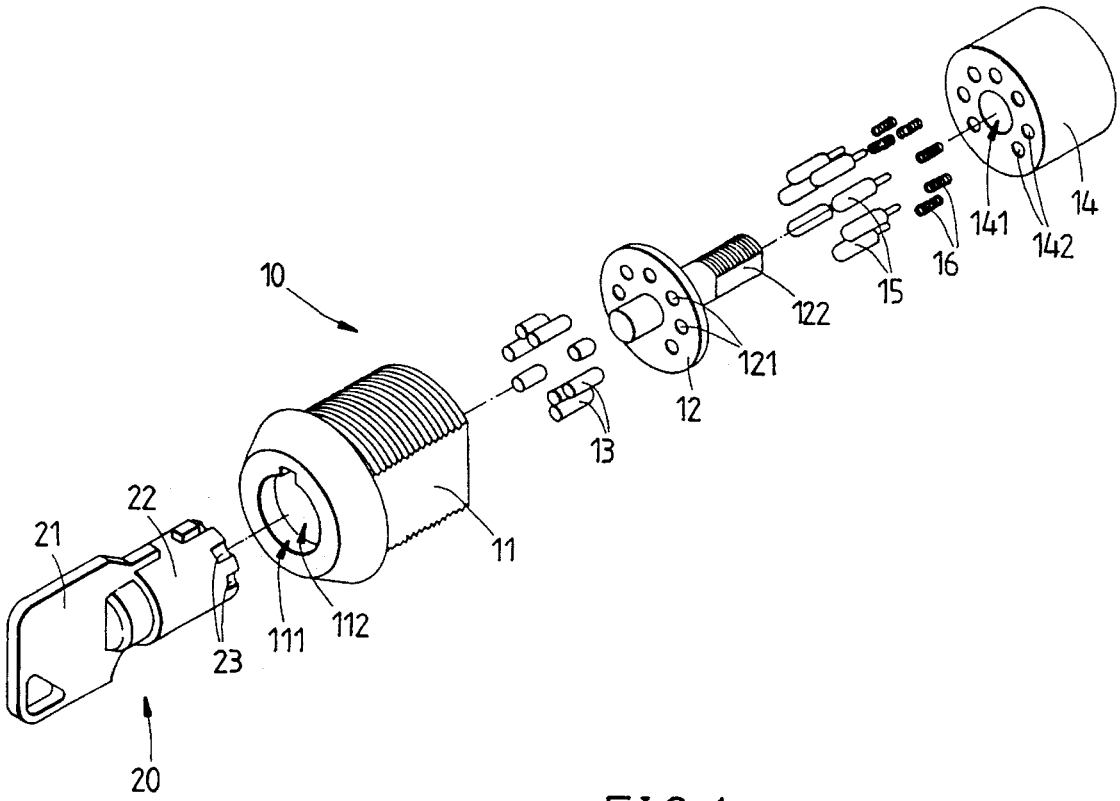
FIG. 1 (PRIOR ART)
FIG. 1 shows an exploded view of an axial pin tumbler lock of the prior art and a key therefor.
Figure 2:
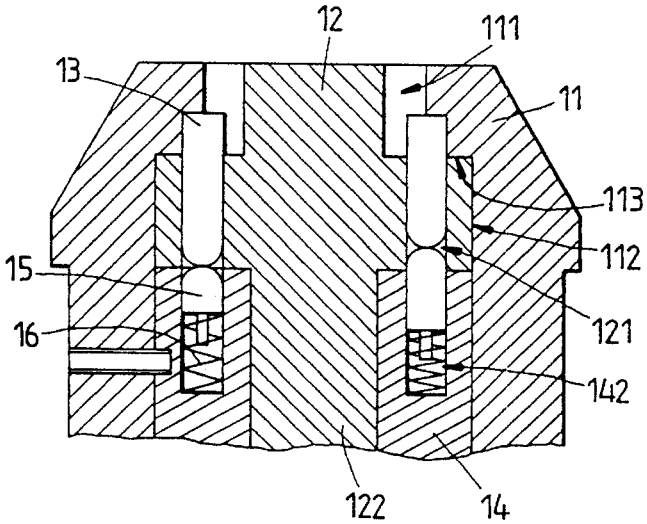
FIG. 2 (PRIOR ART)
FIG. 2 shows a sectional view taken along the direction of the axis of the axial pin tumbler lock of the prior art.
Figure 3:
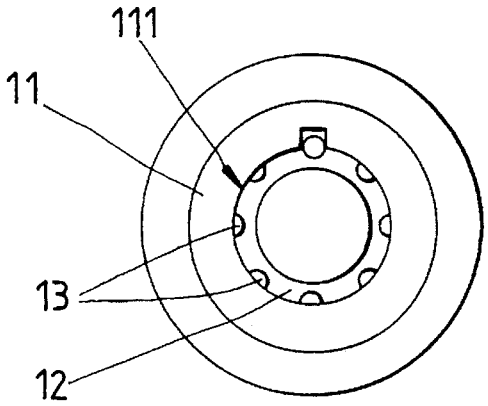
FIG. 3 shows a front view of the axial pin tumbler lock of the prior art.
Figure 4:
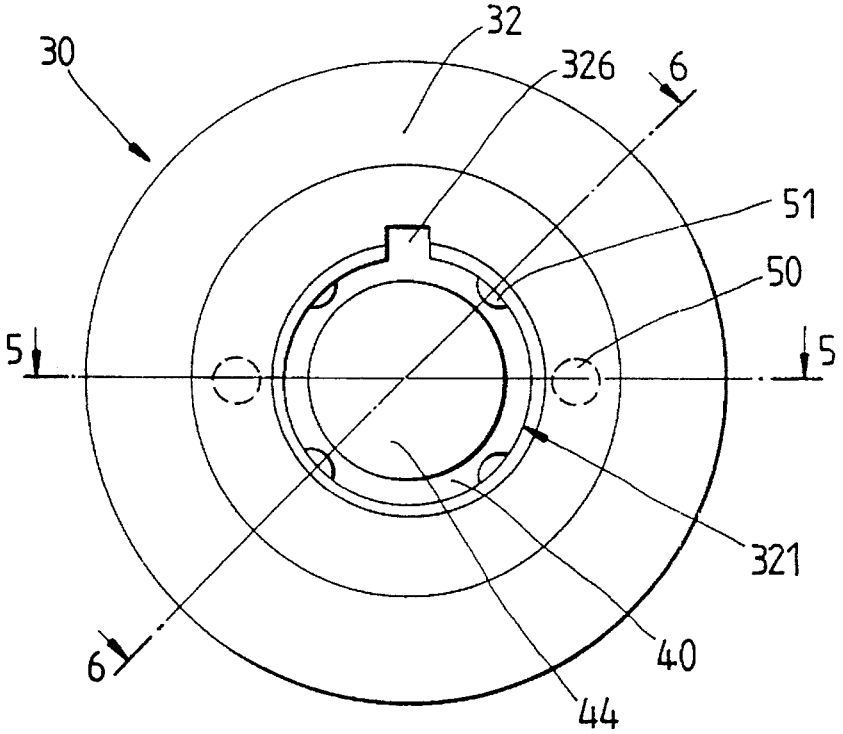
FIG. 4 shows a front view of an axial pin tumbler lock of the present invention.
Figure 5:
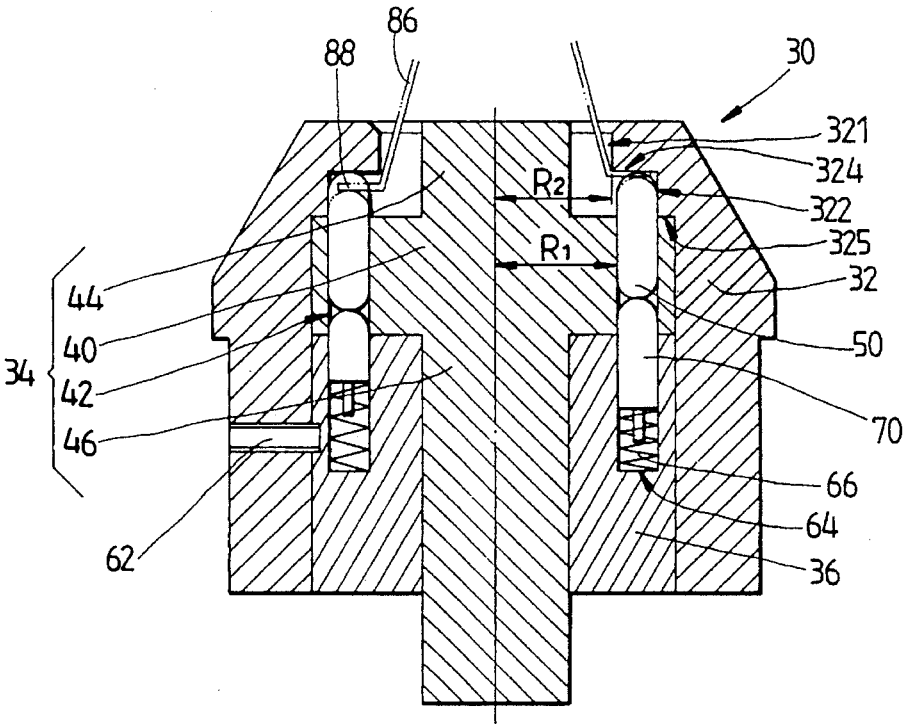
FIG. 5 shows a sectional view of a portion taken along the direction indicated by the line 5—5 as shown in FIG. 4.
Figure 6:
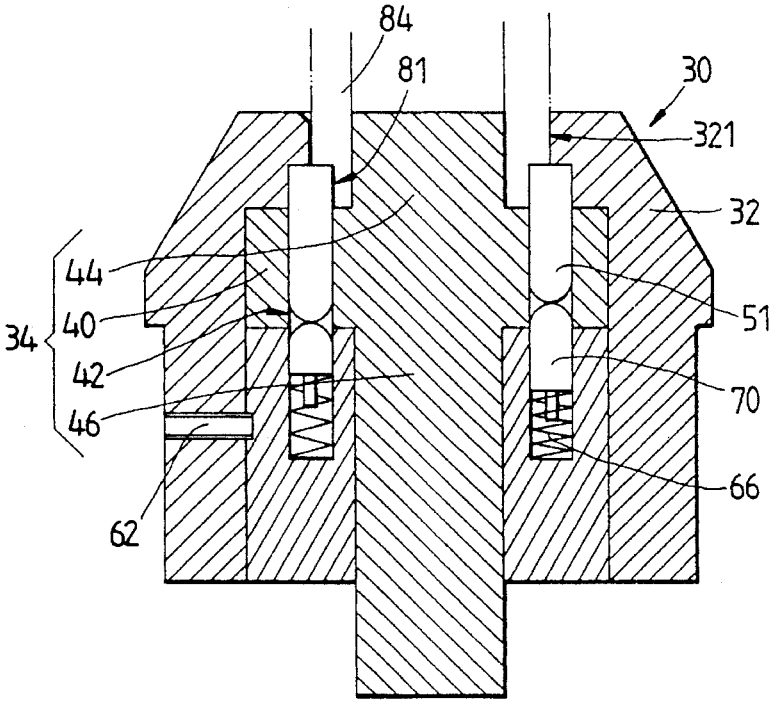
FIG. 6 shows a sectional view of a portion taken along the direction indicated by the line 6—6 as shown in FIG. 4.

As shown in FIGS. 4–6, an axial pin tumbler lock 30 embodied in the present invention comprises a housing 32, an outer tumbler pin seat 34, and an inner tumbler pin seat 36.

The housing 32 of a tubular construction is provided coaxially with a first axial hole 321, a second axial hole 322, and a third axial hole 323. The first axial hole 321 of a predetermined length extends inwards from the outer side of the housing 32 while the third axial hole 323 of a predetermined length extends outwards from the inner side of the housing 32. The third axial hole 323 has an inner diameter greater than the inner diameter of the first axial hole 321. The second axial hole 322 has an inner diameter which ranges between the two inner diameters of the first and the third axial holes 321 and 323. Located between the first and the third axial holes 321 and 323 are a first shoulder 324 and a second shoulder 325, which are respectively ring-shaped in construction and face inwardly toward the housing 32. The first axial hole 321 is provided in the inner wall thereof with a locating slot 326.

The outer tumbler pin seat 34 is disposed in the interior of the housing 32 such that the outer tumbler pin seat 34 is rotatable along the direction of the axis of the housing 32. The outer tumbler pin seat 34 has a cruciform section which is taken along the direction of the axis of the outer tumbler pin seat 34. The outer tumbler pin seat 34 is provided with a disklike body 40 which is in turn provided with two first through holes 42 which are separated at an interval of 180 degrees. Located between the two first through holes 42 are two pairs of second through holes.43. The body 40 has an outer diameter corresponding to the inner diameter of the third axial hole 323 and further has a periphery making contact with the second shoulder 325. The body 40 is provided centrally with a rod 44 extending outwards to react the insides of the first and the second axial holes 321 and 322. The rod 44 has an outer diameter smaller than the inner diameter of the first axial hole 321. A lock core 46 extends inwards from the center of the body 40. A pair of first outer tumbler pins 50 and two pairs of second outer tumbler pins 51 are disposed respectively in the first and the second through holes 42 and 43 such that the first and the second outer tumbler pins 50 and 51 can be caused to slide axially.

The inner tumbler pin seat 36 is disposed in the third axial hole 323 such that the outer end of the inner tumbler pin seat 36 presses against the inner end of the outer tumbler pin seat 40, and that the inner tumbler pin seat 36 is fastened by a pin 62. The inner tumbler pin seat 36 is provided with six recesses 64 corresponding in location to the inner ends of the first and the second through holes 42 and 43, and with six springs 66 disposed respectively in the six recesses 64, and further with six inner tumbler pins 70 of an appropriate length. The six inner tumbler pins 70 are disposed in the recesses 64 such that the inner tumbler pins 70 are urged by the springs 66 so as to press against the first and the second outer tumbler pins 50 and 51. As a result, the outer ends of the first and the second outer tumbler pins 50 and 51 urge against, respectively, the first shoulders 324.

The embodiment of the present invention described above is characterized in that the smallest distance R1 between the center of the body 40 and the outer edge of each of the first outer tumbler pins 50 is greater than the radius R2 of the first axial hole 321. As a result, each of the outer tumbler pins 50 is concealed by the first shoulder 324 and can not be therefore seen from the outer end of the housing 32.

Figure 7:
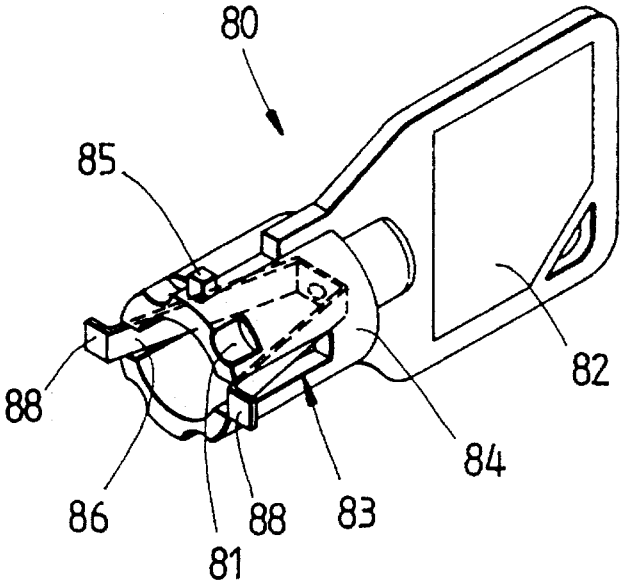
FIG. 7 shows a perspective view of a key of the axial pin tumbler lock of the present invention.
Figure 8:
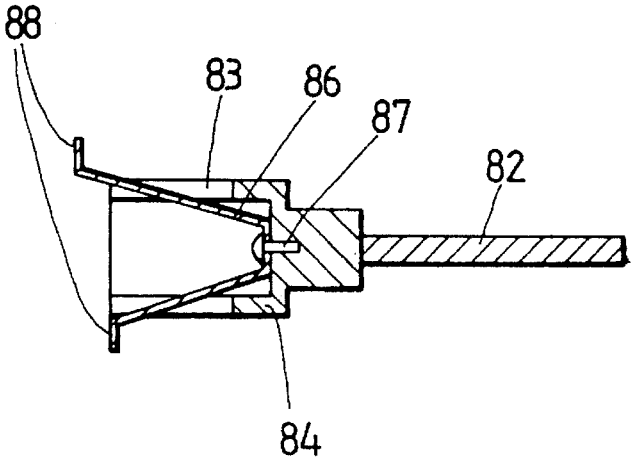
FIG. 8 shows a sectional view taken along the direction of the axis of the key of the axial pin tumbler lock of the present invention.

Now referring to FIGS. 7 and 8, a key 80 for use in locking and unlocking the axial pin tumbler lock 30 of the present invention is shown comprising a flat handle 82, a body 84 of a cylindrical construction, and an elastic pushing member 86 which may be a spring. The body 84 is fastened at one end thereof with the handle 82 and is provided at the free end thereof with four retaining slots 81, two indentations 83, and a locating block 85 located on the outer edge thereof. The four retaining slots 83 are arranged circularly in the outer edge of the body 84 while the two indentations 83 extend through the inner edge and the outer edge of the body 84. The pushing member 86 is disposed in the body 84 such that the midsegment of the pushing member 86 is fastened to the bottom end of the body 84 by a fastening screw 87. The pushing member 86 is provided at the outer end thereof with a pushing portion 88 perpendicular to the axis of the body 84.

In operation, the key 80 is inserted into the housing 32 such that the locating block 85 of the body 84 of the key 80 is aligned with the locating slot 326, and that the end of the elastic pushing member 86 is caused by the inner wall of the first axial hole 321 to curve upwards. Thereafter, as the pushing member 86 is forced into the second axial hole 322, it causes the pushing portion 88 to be located between the first shoulder 324 and the other end of the first outer tumbler pin 50. With the cooperation of the retaining slots 81, the first and the second outer tumbler pin 50 and 51 are pushed inwards, so as to enable the lock core 46 to be rotated.

What is claimed is:

1. An axial pin tumbler lock comprising:

a housing provided with a first axial hole, a second axial hole, a third axial hole, the first axial hole, the second axial hole, and the third axial hole all being coaxial, the housing including a first shoulder located between said first axial hole and said second axial hole and a second shoulder located between said second axial hole and said third axial hole, said first axial hole provided in an inner wall thereof with a locating slot:

an outer tumbler pin seat mounted rotatably in said housing and provided with a lock core, a plurality of through holes, and a plurality of outer tumbler pins which are equal in number to said through holes and are respectively and slidably disposed in said through holes; and an inner tumbler pin seat fixed in said housing and provided with a plurality of recesses corresponding in location to said through holes, said recesses provided therein respectively with a biasing means and an inner tumbler pin which is slidable along the direction of an axis of said recesses and is urged at one end thereof by said biasing means so as to enable another end of said inner tumbler pin to urge an inner end of said outer tumbler pin, thereby causing an outer end of said outer tumbler pin to press against said first shoulder;

wherein the plurality of through holes of said outer tumbler pin seat comprises a first set of holes and a second set of holes;

wherein tumbler pins slidably disposed in the first set have a first minimum distance from the axis of less than a radius of said first axial hole;

wherein tumbler pins slidably disposed in the second set have a second minimum distance from the axis of more than a radius of said first axial hole; and wherein the second set includes at least one hole.

2. An axial pin tumbler lock comprising:

a housing provided with a first axial hole, a second axial hole, a third axial hole, the first axial hole, the second axial hole, and the third axial hole all being coaxial, the housing including a first shoulder located between said first axial hole and said second axial hole and a second shoulder located between said second axial hole and said third axial hole, said first axial hole provided in an inner wall thereof with a locating slot:

an outer tumbler pin seat mounted rotatably in said housing and provided with a lock core, a plurality of through holes, and a plurality of outer tumbler pins which are equal in number to said through holes and are respectively and slidably disposed in said through holes; and an inner tumbler pin seat fixed in said housing and provided with a plurality of recesses corresponding in location to said through holes, said recesses provided therein respectively with a biasing means and an inner tumbler pin which is slidable along the direction of an axis of said recesses and is urged at one end thereof by said biasing means so as to enable another end of said inner tumbler pin to urge an inner end of said outer tumbler pin, thereby causing an outer end of said outer tumbler pin to press against said first shoulder;

wherein the plurality of through holes of said outer tumbler pin seat comprises a first set of holes and a second set of holes;

wherein tumbler pins slidably disposed in the first set have a first minimum distance from the axis of less than a radius of said first axial hole;

wherein tumbler pins slidably disposed in the second set have a second minimum distance from the axis of more than a radius of said first axial hole;

wherein the second set includes at least one hole; and further comprising a key, which includes a handle, a body of a cylindrical construction, and an elastic pushing member including a pushing portion extending beyond retaining slots at an outer end of said body.

3. The axial pin tumbler lock according to claim 2 wherein said pushing member has an elastic portion enabling said pushing portion to move between an inner edge and an outer edge of said body.

4. The axial pin tumbler lock according to claim 2 wherein said body is provided with an indentation corresponding in location to said pushing member.

5. The axial pin tumbler lock according to claim 2 wherein said indentation has a predetermined length and extends from a free end of said body along the direction of an axis of said body toward said handle of said key.

6. An axial pin tumbler lock comprising:

a housing provided with a first axial hole, a second axial hole, a third axial hole, the first axial hole, the second axial hole, and the third axial hole all being coaxial, the housing including a first shoulder located between said first axial hole and said second axial hole and a second shoulder located between said second axial hole and said third axial hole, said first axial hole provided in an inner wall thereof with a locating slot:

an outer tumbler pin seat mounted rotatably in said housing and provided with a lock core, a plurality of through holes, and a plurality of outer tumbler pins which are equal in number to said through holes and are respectively and slidably disposed in said through holes; and an inner tumbler pin seat fixed in said housing and provided with a plurality of recesses corresponding in location to said through holes, said recesses provided therein respectively with a biasing means and an inner tumbler pin which is slidable along the direction of an axis of said recesses and is urged at one end thereof by said biasing means so as to enable another end of said inner tumbler pin to urge an inner end of said outer tumbler pin, thereby causing an outer end of said outer tumbler pin to press against said first shoulder;

wherein a smallest distance between an axis of said housing and an outer edge of at least one of said outer lock bolts is greater than a radius of said first axial hole;

further comprising a key, which includes a handle, a body of a cylindrical construction, and a pushing member including a pushing portion extending beyond an outer end of said body;

wherein said pushing member is a spring which has a predetermined length and is fastened to said body; and wherein said pushing portion is made integrally with said spring and is perpendicualr to an axis of said body.

7. The axial pin tumbler lock according to claim 6 wherein said spring has a portion having a predetermined length and extending beyond a free end of said body.

* * * * *